US005662515A

United States Patent [19]

Evensen

[11] Patent Number: 5,662,515

[45] Date of Patent: Sep. 2, 1997

[54] METHOD AND APPARATUS FOR ABRADING WITH A PROFILED SOFT ROLLER

[76] Inventor: Kenneth Evensen, 1429 Fremont Ave., Bartlett, Ill. 60103

[21] Appl. No.: 632,794

[22] Filed: Apr. 17, 1996

Related U.S. Application Data

[63] Continuation-in-part of Ser. No. 409,863, Apr. 26, 1995, Pat. No. 5,567,197, which is a continuation-in-part of Ser. No. 324,806, Oct. 18, 1994, Pat. No. 5,564,971, which is a continuation-in-part of Ser. No. 168,042, Dec. 15, 1993, Pat. No. 5,365,628.

[51] Int. Cl.[6] ..... B24D 9/02

[52] U.S. Cl. ..... 451/59; 451/352; 451/358; 451/495; 451/507; 451/527; 451/529

[58] Field of Search ..... 457/59, 352, 358, 457/495, 504, 507, 516, 527, 529

[56] References Cited

U.S. PATENT DOCUMENTS

| | | | |
|---|---|---|---|
| 1,325,937 | 12/1919 | Fox . | |
| 2,221,173 | 11/1940 | Gutsell | 51/191 |
| 2,483,422 | 10/1949 | Larson | 51/191 |
| 3,597,883 | 8/1971 | Choplin | 51/170 PT |
| 3,648,413 | 3/1972 | Godwin et al. | 451/352 |
| 3,688,453 | 9/1972 | Legacy et al. | 51/400 |
| 3,790,980 | 2/1974 | Sylvie | 15/23 |
| 3,793,782 | 2/1974 | Bowling | 51/170 PT |
| 3,815,290 | 6/1974 | McDowell | 451/358 |
| 3,965,521 | 6/1976 | Wardell | 451/504 |
| 4,177,611 | 12/1979 | Carr-Rollett . | |
| 4,380,092 | 4/1983 | Brothers | 15/209 |
| 4,694,616 | 9/1987 | Lindberg | 512/170 EB |
| 4,962,562 | 10/1990 | Englund et al. | 451/530 |
| 5,007,208 | 4/1991 | Garfield | 512/281 R |
| 5,336,330 | 8/1994 | Shumway et al. | 451/527 |
| 5,380,239 | 1/1995 | Casillas et al. | 451/496 |
| 5,492,498 | 2/1996 | Casillas et al. | 451/59 |

FOREIGN PATENT DOCUMENTS 559229 9/1932 Germany .

OTHER PUBLICATIONS

"Coated Abrasives—Modern Tool of Industry", Coated Abrasives Manufacturers' Institute, First Edition, 1958, pp. 46–49 and 72–77.

3M Product Literature, "Scotch–Brite™ and Roloc™ Surface Conditioning Discs", 1988.

3M Product Literature, "Scotch–Brite™ Surface Conditioning Belts", 1991.

3M Product Literature, "Scotch–Brite™ Surface Conditioning Products", 1992.

Johnannsen Maschinen und Apparatebau GmbH & Co. KG Product Literature, "Formteil–Schleifmaschine", May 1993.

*Primary Examiner*—Eileen P. Morgan
*Attorney, Agent, or Firm*—Fitch, Even, Tabin & Flannery

[57] ABSTRACT

A profiled, soft cushioned roller is provided with an outer profiled abrading surface that conforms to and rides on a contoured substrate surface during an abrading operation. A soft roller usually in the form of a soft foam layer or body allows the profiled abrading surface to extend to and laterally wrap itself along the contoured substrate surface when pushed against the latter with the force needed to abrade the contoured surface. Because the outer surface portion of the profiled, soft roller is able to distort and wrap across the contoured surface, the soft profiled portion need not have the exact contoured shape and dimensions of the contoured surface being abraded. The soft roller body may have portions with different hardness by using different materials or different densities of the same foam material. The abrading surface may be a separable piece having a one-way clutch connection to an interior driving portion of the roller, or it may be an abrasive grit or the like integrally bonded or integrally embedded in the outer circumferential portion of the roller.

18 Claims, 7 Drawing Sheets

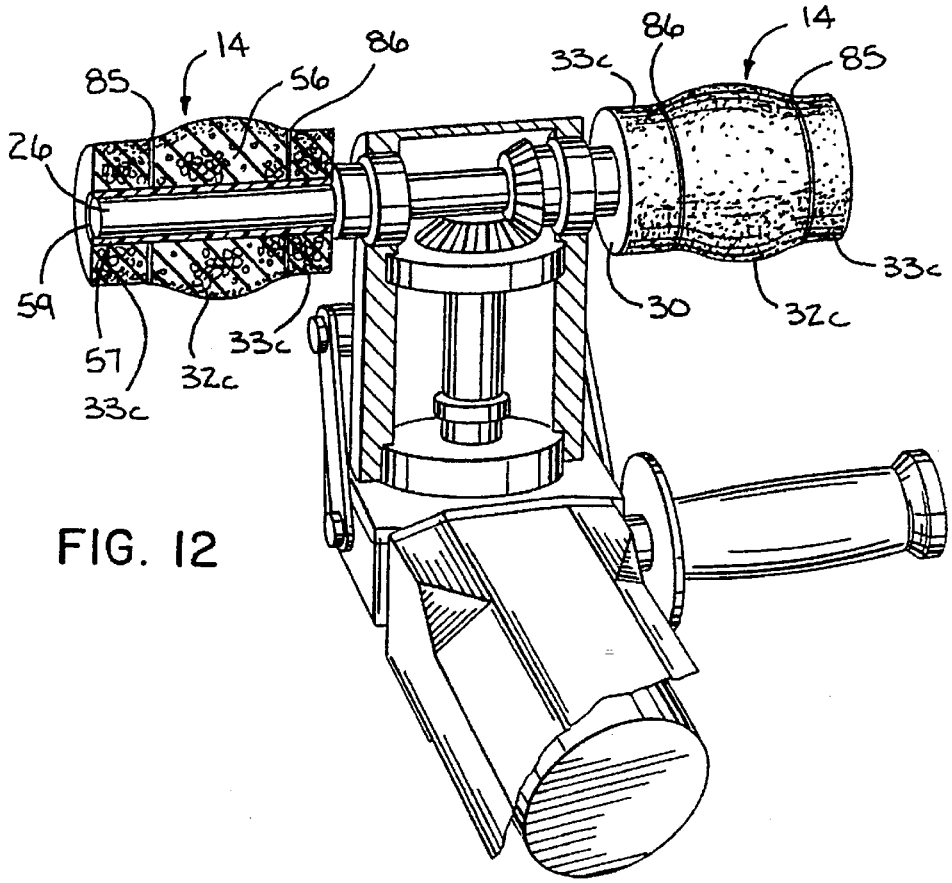
FIG. 12
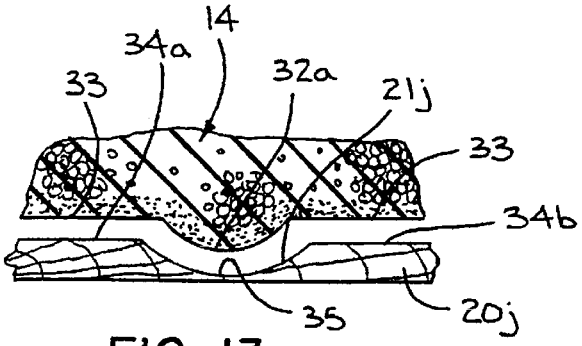
FIG. 13
FIG. 13A
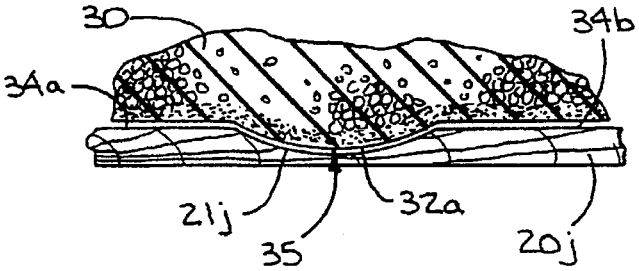

METHOD AND APPARATUS FOR ABRADING WITH A PROFILED SOFT ROLLER

This application is a continuation-in-part of application Ser. No. 08/409,863 filed Apr. 26, 1995 now U.S. Pat. No. 5,567,197, which in turn is a continuation-in-part of application Ser. No. 08/324,806 filed Oct. 18, 1994 now U.S. Pat. No. 5,564,971, which in turn is a continuation-in-part of application Ser. No. 08/168,042, filed Dec. 15, 1993 now U.S. Pat. No. 5,365,628.

BACKGROUND OF THE INVENTION

This application relates to a method and apparatus for abrading contoured surfaces on substrates such as wood substrates.

A very substantial amount of wood surfaces on various pieces of furniture, picture frames, chair rail moldings, crown moldings, floor moldings, doors, etc. have grooves or convex round surfaces that either curve circumferentially as about the edge of a rounded table or extend in a straight line, as on a molding or door. Typically, such contoured surfaces are abraded by hand using pieces of sandpaper or abrasive material embedded in a flat piece of foam. Also, there are so-called "profile" sanders in which a hard pad is contoured to the shape of the substrate surface which is provided with a peelable layer of abrasive, sandpaper and is reciprocated through short strokes by a motor. The operator of this hand-held, profile sanding apparatus pushes it along the contoured substrate surface to sand it. Because the peelable sandpaper layer is attached to a non-rotating, reciprocating, hard layer of rubber of a reciprocating profile sander, the contour of the hard rubber must match very substantially the contour of the surface of the substrate. If the hard rubber contour is slightly larger than, e.g., a contoured groove, then the edge of the sandpaper tends to dig into the edges of the smaller groove. If a concave surface on the hard rubber, profile sander is larger in diameter than the diameter of the convex substrate surface, the abrasive sandpaper rides along one or more spaced straight line surfaces rather than wrapping laterally about and sanding the entire convex surface. These profile sanders that reciprocate are very unforgiving in the sense that it will not conform with the surface and will cause "change of direction" marks on substrates, as well as chattering with higher grit sandpaper.

SUMMARY OF THE INVENTION

In accordance with the present invention, there is provided a new and improved method of and apparatus for linear abrading substrates, particularly non-planar surfaces such as grooves, concave or convex rounded surfaces, fillets, bevels, door lips or other decorative edges. This is achieved by abrading with a profiled, soft cushioned roller that conforms to and rides on the contoured substrate surface. The abrading roller's outer surface need be profiled only to the general shape of the contoured surfaces, because the soft forgiving nature of the soft roller, usually a soft foam layer or foam body, allows the profiled abrading surface to extend and to wrap itself laterally along the substrate surface when pushed with force needed for abrading the contoured substrate surface. The soft, profiled roller also flattens in the linear direction of travel when the roller is pushed forcibly against the contoured substrate. This provides a wide area of contact for abrading of the substrate surface as contrasted to a straight line of contact achieved with a hard roller.

Because the outer surface portion of the profiled, soft foam body is able to distort and wrap, this profiled portion of the roller body need not have the exact contour shape and dimensions of the contoured substrate surface being sanded. Thus, the radius of a convex profiled shape on the roller need not match exactly the radius of a groove; and hence, the same contoured roller of this invention may be used for several different radii grooves, whereas hard rollers can be used only for a single, matching radius groove. This is particularly useful in limiting the number of roller profiles that must be manufactured and to the number of different sizes needed for the same roller profile. Thus, the soft, profiled roller system allows more generic sizes and shapes in contrast to hard reciprocating profile sanders which must be customized to the particular contour or else they will leave gaps, chatter or abrade unevenly.

Also, because the profiled, soft roller bends and deflects and flows across the contoured substrate surface, it abrades over high spots and into low spots better than hard abrading surfaces that cannot flow into a low spot or deflect about a high spot.

In accordance with the present invention, the outer profiled portion of the soft roller body is provided with an outer layer of abrading material, such as abrasive grit or the like, rather than an attached sleeve. It is preferred that the soft roller body be a plastic foam that has grit integrally embedded in or bonded to its outer surface circumferential portion of the roller. The present invention also encompasses the use of separate sleeves or sheets of abrading material circumferentially applied to the outer circumferential surface of the soft roller body. In some instances, there is provided a one-way driving connection between an outer sleeve and interior driving portion of the roller, as disclosed in aforesaid patent applications. Alternatively, the abrading layer may be a flat sheet that is adhered by an adhesive or other securing means to the outer contoured surface of the roller. If a sheet is applied to the roller, it is preferred that the edges thereof meet along a bias or a helical line on the profiled surface so that a meeting line does not extend parallel to the rotational axis of the roller. It is preferred that only a partial seam contact the substrate rather than a full line of seam contact with the substrate because the latter may mar the substrate surface.

Also, in accordance with the invention, the roller body may be formed with portions of different hardness by using different materials, different densities, or a hard glue line used to glue foam sections together to give different hardness sections for the roller body. This is useful to obtain a better abrading contact, e.g., into sharp corners or along edges or to have the profile of the foam retain a sharp, harder edge when sanding. For instance, the central body of the contoured roller may be made with the usual soft foam of a low density while outer, sharp edges are formed with a harder foam of a higher density sandwiched between the softer foam. The higher density foam may provide stiffness at sharp edges of the profile to mate with sharp edges on the profiled substrate. Also, cuts may be made in the foam to separate different sections of the roller contours to allow these different sections to operate more independently.

BRIEF DESCRIPTION OF THE DRAWINGS

FIG. 12 is a another view of an apparatus or tool having a pair of soft contoured rollers which have separate and discreet, large and small diameter sections;

FIG. 13 is a view of a contoured roller having a enlarged diameter, central section which has a lateral dimension smaller than the dimension of an underlying groove in the substrate;

FIG. 13A illustrates the soft roller of FIG. 13 having its central section pushed into and wrapped laterally;

DETAILED DESCRIPTION OF THE PREFERRED EMBODIMENT

Figure 1:
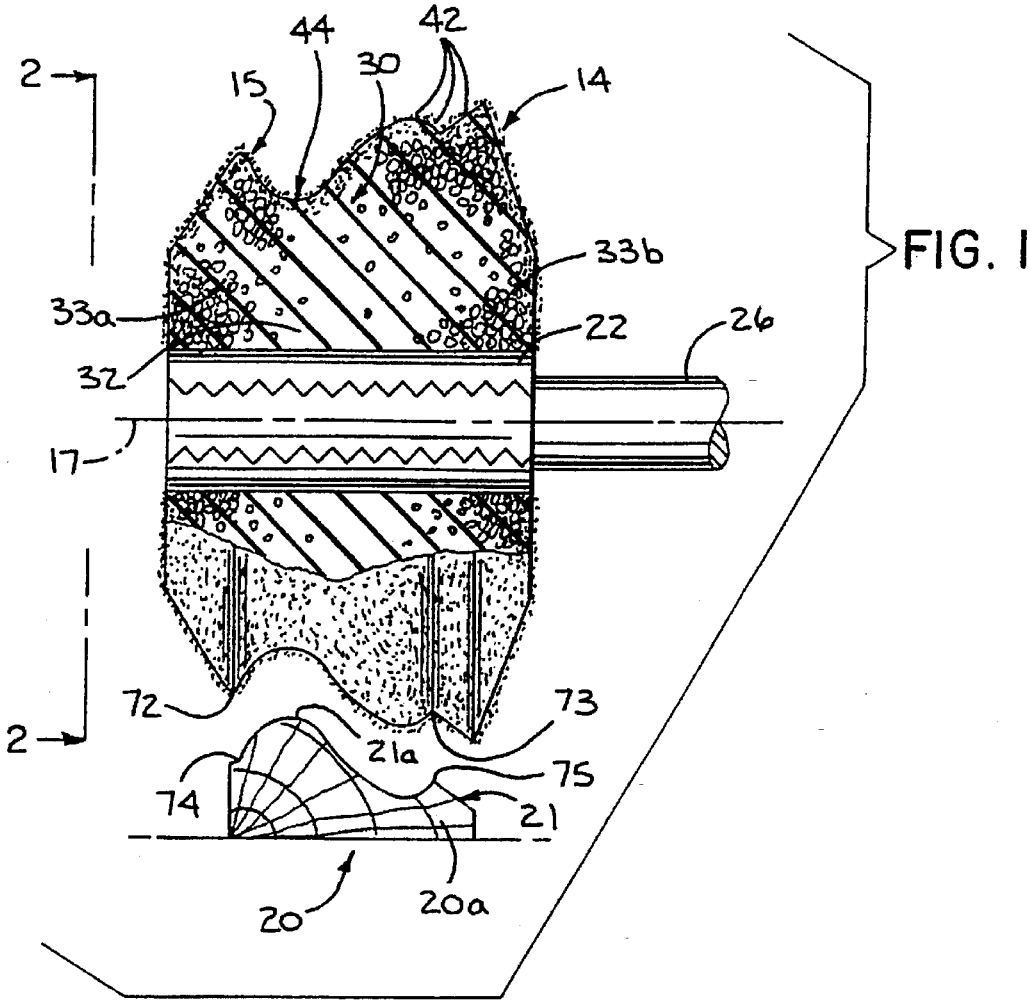
FIG. 1 is a cross-sectional view of a profiled abrading roller for abrading a contoured substrate.
Figure 2:
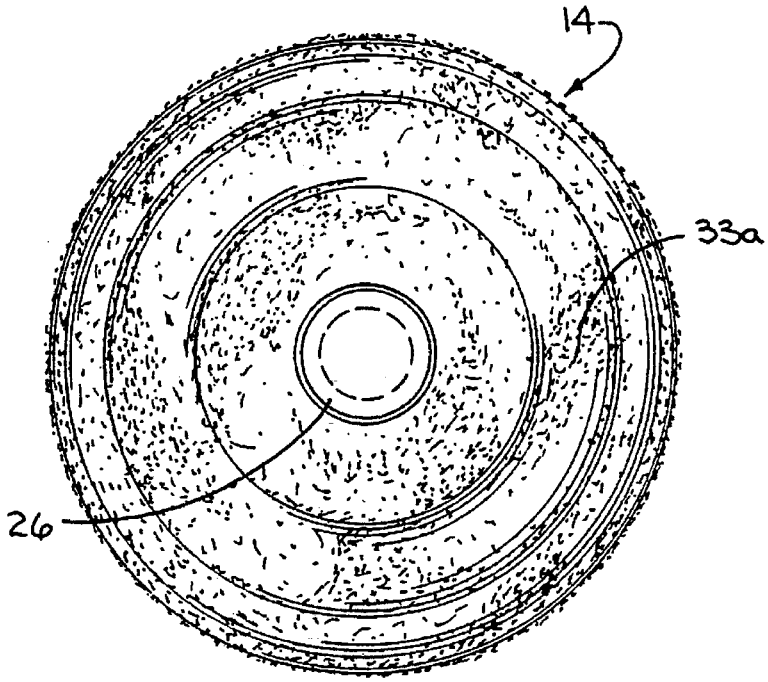
FIG. 2 is an enlarged end view of the profile soft roller of FIG. 1.

As shown in the drawings for purposes of illustration, the invention is embodied in a sanding apparatus 10 (FIG. 1A) that comprises a motor 12 for rotating an abrading roller 14 with an abrading surface 15. The sanding apparatus may be in the form of a drill tool that has a chuck to grip the roller shaft or a large stationary apparatus. The roller 15 is mounted for rotation in a frame body or housing 16 about a longitudinal, central axis 17 through the roller. While a hand-held tool or apparatus 10 is illustrated herein for being pushed along a substrate 20, it is to be understood that the apparatus may include a large, machine-mounted roller which rotates but does not travel linearly with the substrate being carried by a table or carriage past the stationary, rotating roller. Typically, the roller has a central hub 22 which may be detachably mounted to a central shaft 26 that is driven by the motor. When it is desired to replace a roller, it is slid axially from the shaft 26, and a new roller is then slid axially back onto the shaft.

Figure 14:
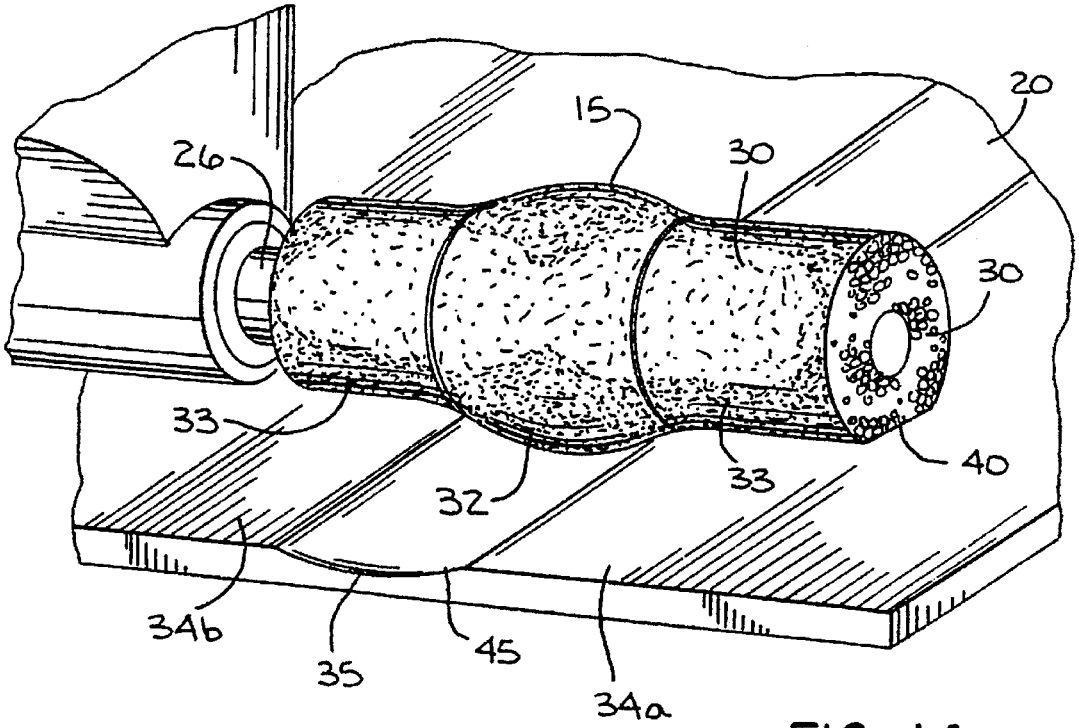
FIG. 14 is a view of a substrate and contoured roller of FIGS. 13 and 13A.

In accordance with the present invention, there is provided a new and improved method of and apparatus 10 for sanding various contoured surfaces generally identified by the reference character 21 and specifically identified by the reference characters **21*a*–21*j* on various substrates 20*a*–20*j* (FIGS. 2, 3–11). This is achieved by providing the abrading roller 14 with a contoured, soft roller body or outer layer 30 that spreads laterally when pushed forcibly against the substrate and which flattens at an area of contact in the linear travel direction of substrate travel relative to the rotating roller 14. More specifically, as seen in FIGS. 13 and 14, a rounded or convex roller body section 32 has a convex surface 32*a* formed with a radius smaller than the radius of the groove surface 21*j* of a groove 35 in the substrate 20*j* when the roller is above the groove 35. However, when the roller is pushed forcibly into the groove 35, as seen in FIGS. 13A and 14, the convex roller surface 32*a* expands laterally to fill the groove 35, as best seen in FIGS. 13A and 14. If the roller body section 32 had been made of a hard material, it could not have expanded laterally to fill the groove 35, as did the soft body section 32. Adjacent lateral sections 33 on the roller body 30 engage and abrade the side edges 34*a* and 34*b*** of the substrate adjacent the groove.

Looking in the other direction, i.e., the linear direction of travel of the profiled, soft roller body 30 along the substrate 20 (FIG. 14), the convex roller section 32 will be deflected to form an elongated flat 40 (FIG. 14) where the roller body 30 is compressed. That is, at the substrate surface, the convex shape is deformed in the linear direction to form the flat 40 thereon by the person forcing the roller body tightly against the substrate. As explained more fully in the aforesaid patent applications, the flat 40 provides a larger surface area of contact than a single line of contact from a hard roller. Also, the soft roller will conform to and fill holes 45 (FIG. 14) in the substrate where a hard roller will not bulge into a hole 45.

In this preferred embodiment of the invention, the abrading surfaces 15 on both the large diameter, convex section 32 and the smaller diameter lateral sections 33 of the roller body are covered with particles of grit 42 embedded bonded or otherwise attached in an outer peripheral layer 44 of the foam body. Alternatively, the abrading surface 15 may be made by wrapping a parallelogram-shaped sheet 48 (FIG. 6) about a soft roller 30 (FIG. 15) with diagonal edges 49 and 50 meeting along a helical or a line 51 biased with respect to the longitudinal axis 17 of the roller. The preferred sheet 48 has an adhesive layer 52 on its inner surface that is adhered to and peelable from the foam roller body 30. The preferred sheet 48 has a contour surface while the roller body 30 has an outer cylindrical surface so that different profiles on sheets may be adhered to the same roller body 31.

Figure 15:
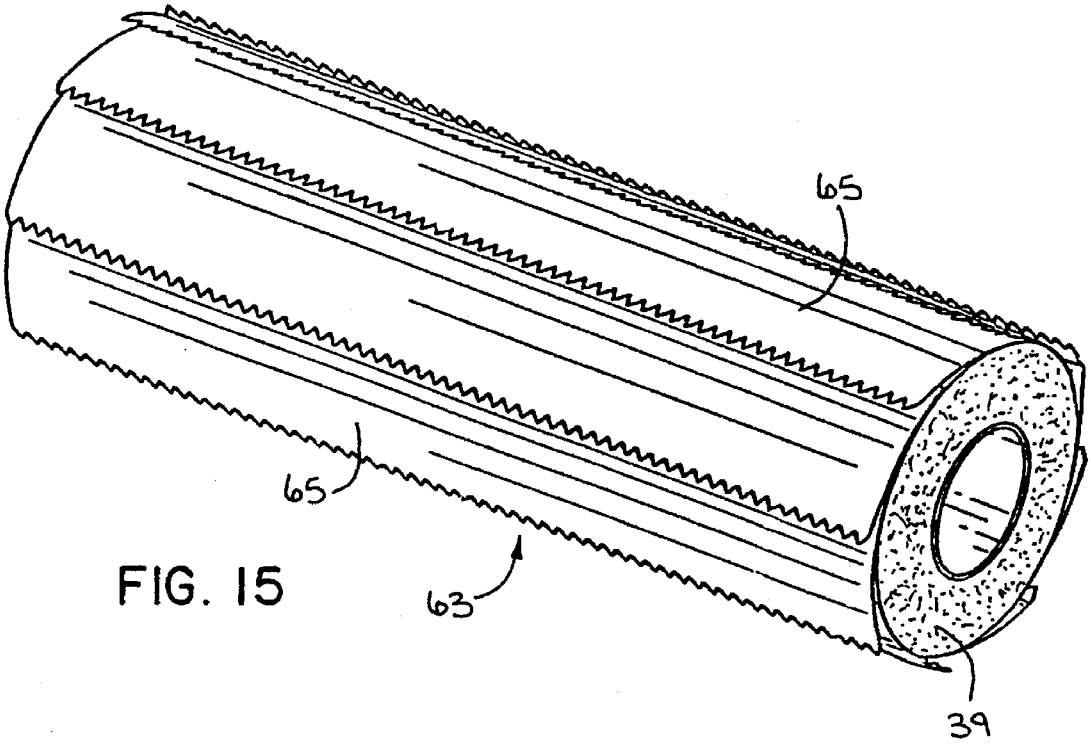
FIG. 15 illustrates an embodiment of the invention wherein the soft roller is provided with a clutch element.
Figure 16:
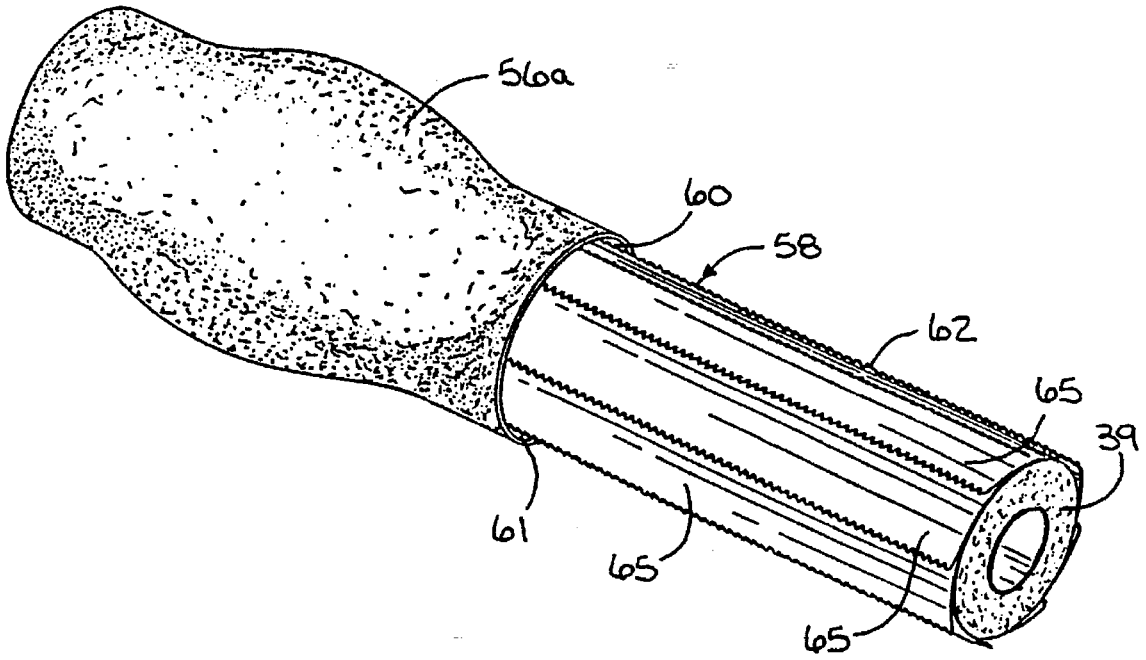
FIG. 16 illustrates the soft roller of FIG. 15 with its clutch receiving a separable sleeve having a contoured shape.

It is also possible, in some instances, to use a one-piece, tubular sleeve 56 (FIG. 1) that is profiled on its outer surface and has a central hub 57 with a hollow bore 59 which is connected to the motor drive shaft 26 of the tool to be rotated by the tool. In the embodiment shown in FIGS. 6 and 16, the tubular sleeve 56 is connected by a clutch 58 to an inner driving roller 63, which also may be made of foam. As best seen in FIGS. 15 and 16, the clutch 58 is preferably formed to be a one-way clutch with a first half 60 on the inner surface of the sleeve 56, and with a second half 62 on the driving roller 63. When the sleeve 56 is rotated in a first direction which is counterclockwise, as seen in FIG. 16, the first clutch half 60 slides over the second clutch half 62 which is preferably made of a low friction material such as plastic strips. When the sleeve 56 is rotated and driven by the roller drive shaft 26 in the clockwise direction, as seen in FIG. 16, teeth 66 on the plastic strips 65 of the second clutch portion 62 bite into a looped surface or other engageable surface 61 of the first clutch half to positively drive the abrading sleeve without slippage between the sleeve and the driving roller 63. Because the second clutch portion is formed of strips 65 of flexible plastic material, the foam body 39 under the strips may form the flat 40 (FIG. 14) in linear direction and provide the wrapped portions in the lateral direction. For a more detailed description of the clutch 58, in its various forms and its manner of operation, reference should be made to the aforesaid patent applications.

Figure 1A:
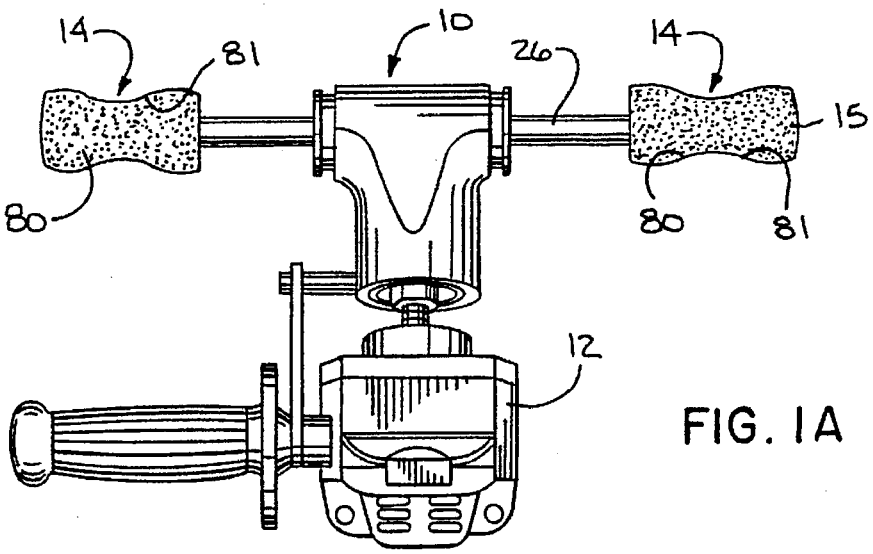
FIG. 1A is a view of profiled rollers attached to an abrading machine.
Figure 3:
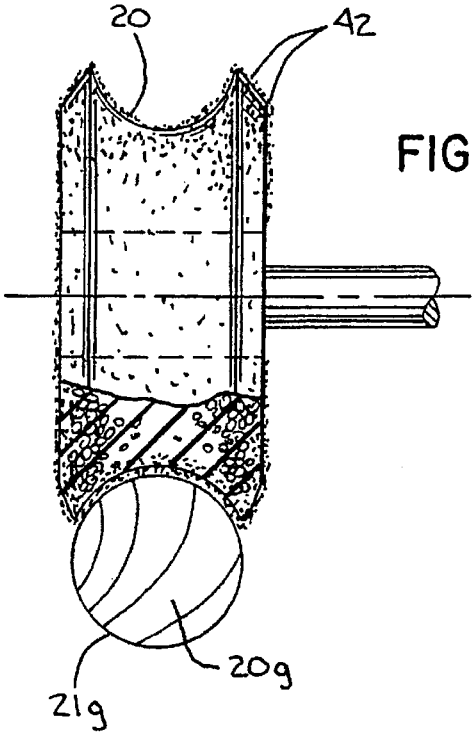
FIG. 3 is a view of a sanding roller rolling a contoured surface having a curvature approximately equal to that of the curvature of the soft sanding roller.
Figure 4:
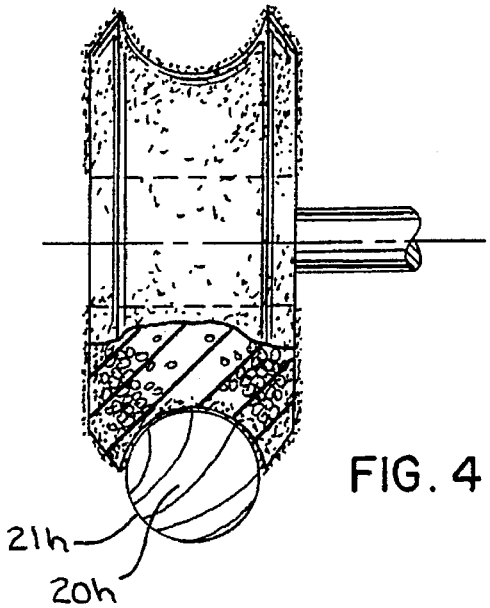
FIG. 4 is a view of sanding roller of FIG. 3 sanding a substrate having a diameter smaller than the diameter of the soft roller.
Figure 5:
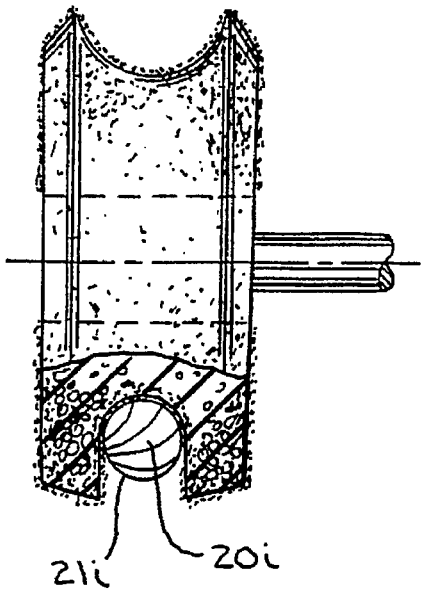
FIG. 5 is a view of the same soft roller of FIGS. 3 and 4 wrapped about a very small diameter curved surface substrate.
Figure 6:
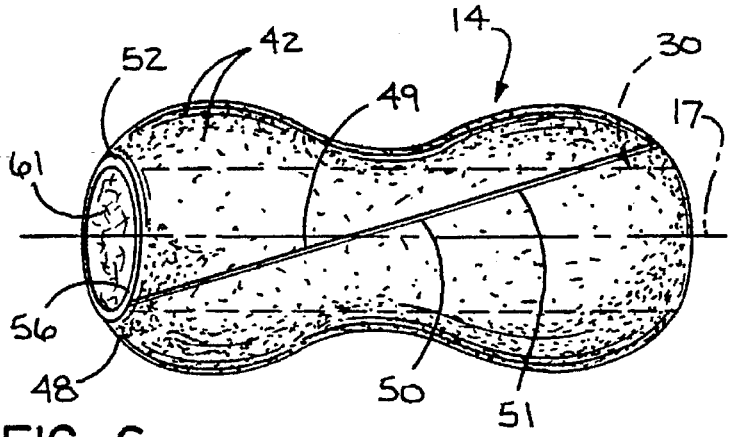
FIG. 6 is a view a contoured shape of another embodiment in which a sanding sheet is wrapped about a roller to form a helical seam where edges of the sheet meet.
Figure 7:
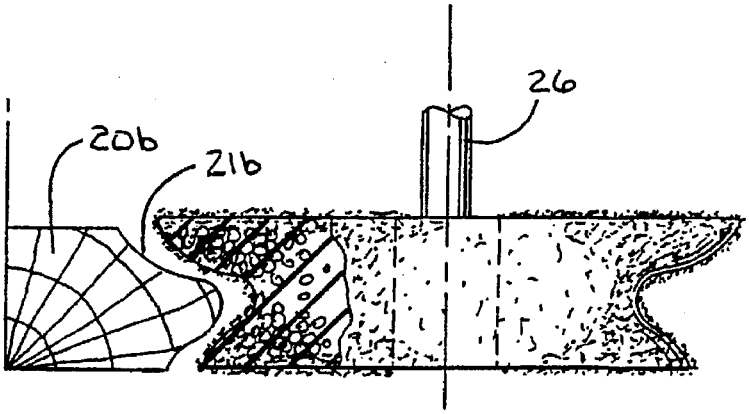
FIG. 7 illustrates another profiled surface on a soft roller and a contoured surface on a substrate.
Figure 8:
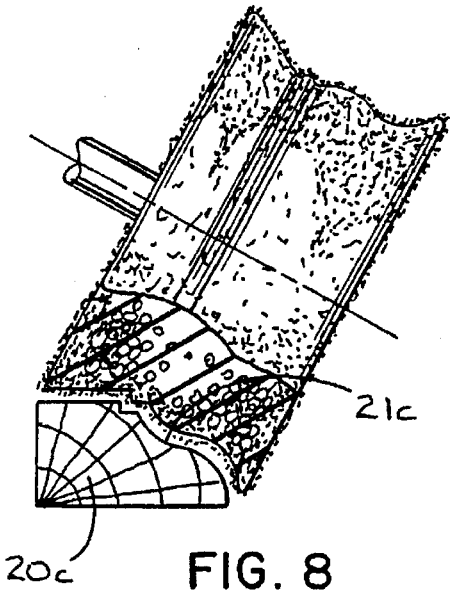
FIG. 8 illustrates another profiled surface on a soft roller used to abrade a similar shaped contoured surface on a substrate.
Figure 9:
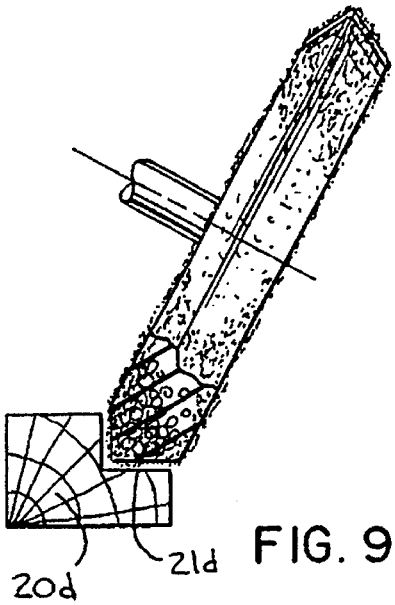
FIG. 9 is a view of a soft roller used to abrade a right angled surface on a substrate.
Figure 10:
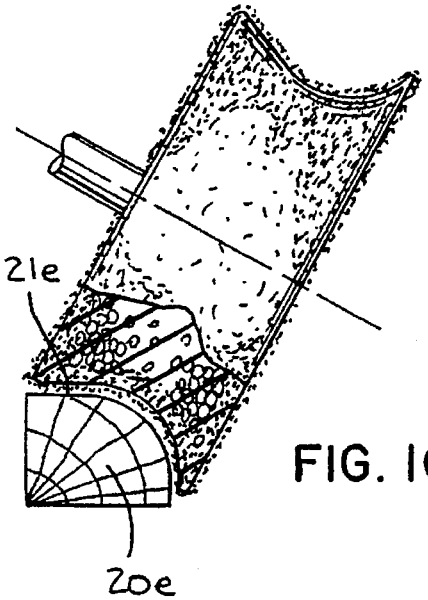
FIG. 10 is a view of another rounded substrate having a soft roller contoured to its shape.
Figure 11:
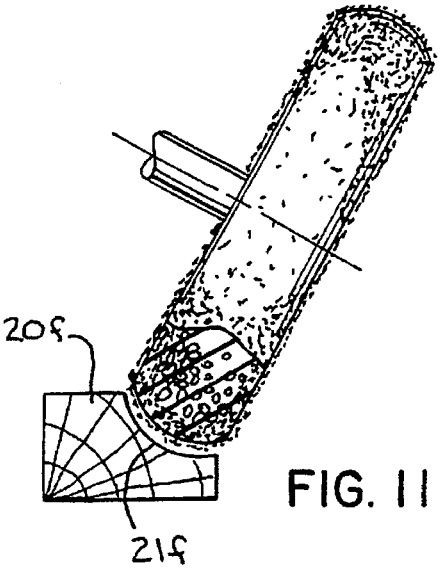
FIG. 11 is a view of a convex contoured surface having a surface matching a concave surface on a substrate.

Also, in accordance with the invention, as best seen in FIG. 1, the profiled roller 14 may have sections 33*a* and 33*b* of greater hardness or firmness than the central softer section 32. Thus, in FIG. 1, the lateral, larger diameter sections 33*a* and 33*b* are formed of denser or different, harder foam materials than is the softer, central body section 32. More specifically, to abrade sharp corners 74 and 75 on the substrate 20*a*, the roller 14 is formed with more dense, harder edges 72 and 73 to give harder, sharp foam portions or edges 72 and 73 than are less likely to deform from their shape than is the softer central section. Preferably, the firmer or harder foam is sandwiched throughout the foam roller body 30 not just on the surface of the body. Another way to achieve this is to take two pieces of the same softness foam, e.g., with different diameters or profiles, and to glue these sections together with a glue or other bonding agent that hardens to form a glue line which is harder and firmer area than the soft foam area. For example, in FIG. 1A, the roller 14 is provided with two lateral sections 33 on opposite sides of a center, smaller diameter section 32 with these sections 32 and 33 of the same firmness. The sections 33 are glued along hard glue lines 80 and 81 to the center section 32. Returning to the roller of FIG. 1, as compared to the softer, central section 32 of the foam body 30, the harder edges 72 and 73 will retain their sharp shape; and hence, will project deeply into the substrate corner 74, and sand will keep a sharp groove 73 on the roller to sand a sharp point 75 on the substrate 20*a* (FIG. 1). Also, slices 85 and 86 (FIG. 12) may be cut into the foam to different depths in the roller body 30 to form first sections 33*c* that are discreet from the second sections 33*c*. These cuts or slices 85 and 86 are made at junctures between portions of the profile to allow these different foam sections to have more independent movement relative to one another as they are pressed against a contoured substrate surface.

A number of different rollers each with a specific profiled body 30*a*–30*j* are shown in FIGS. 1 and 3–11 along with the respective shapes of the substrate being abraded. These body shapes match substantially the shapes formed on substrate surfaces in various ways such as by being molded or being routed by forming bits and cutters. Such grooving and detailing are seen on the edges of furniture, doors, windows, lettering, sign work, templet cutting, veining in cabinets, etc.

What is claimed is:

1. A profiled abrading roller for abrading contoured surfaces on a substrate while rotating about a central axis and traveling linearly relative to the substrate, said profiled abrading roller comprising:

a roller body having an outer profiled surface for substantially matching the contoured surface on the substrate;

a central hub portion on the roller body defining a longitudinal central axis about which the roller body will rotate;

a first section of the roller body extending radially outwardly of the central axis at a first distance;

at least one second section of the roller body extending radially outwardly on the roller body at greater distance than the first distance and joined to the first section to create said outer profiled surface on the roller body;

an abrasive surface on the outer profiled surface of the roller for abrading the contoured surface on the substrate;

the roller body having an outer layer of soft, deformable material that is deformable from its relaxed shape when the profiled roller's abrasive layer is pushed against substrate contoured surface to deflect and to form a flat extending linearly in the direction of substrate travel relative to roller body, the roller body also deflecting laterally to wrap or fill about the substrate contoured surface.

2. A profiled, abrading roller in accordance with claim 1 wherein the abrasive surface comprises abrasive particles embedded into the roller body.

3. A profiled, abrading roller in accordance with claim 1 wherein the roller body comprises a foam body, and the abrasive particles are embedded or bonded into the foam.

4. A profiled, abrading roller in accordance with claim 1 wherein a layer of abrasive material having the abrasive surface thereon is detachably mounted on the roller body.

5. A profiled, abrading roller in accordance with claim 4 wherein the hub portion of the roller body has a clutch portion thereon for clutching engagement with a power-driven tool.

6. A profiled, abrading roller in accordance with claim 5 wherein the clutch portion comprises an engageable, looped material covering a central bore in the hub portion of the roller body.

7. A profiled, abrading roller in accordance with claim 5 wherein the clutch portion comprises a plastic material of low friction material.

8. A profiled, abrading roller in accordance with claim 1 wherein portions of the roller body are formed of different compressibility hardness to aid in abrading sharp corners.

9. A profiled, abrading roller in accordance with claim 1 wherein said different portions of the roller body are formed of plastic foam of a greater density than a plastic foam forming other portions of the roller body.

10. A profiled, abrading roller in accordance with claim 1 wherein the sections are separated; and a hardened material joins adjacent sections together to form harden lines at preselected locations on the roller's profile.

11. A profiled, abrading roller in accordance with claim 1 wherein adjacent sections of the roller body are separated by non-joined, slice areas that allow adjacent sections to move more independently of the adjacent section when pushed against a contoured substrate.

12. A sanding apparatus for abrading contoured surfaces on a substrate while rotating about a central axis and traveling linearly relative to the substrate, said apparatus comprising:

a frame;

a motor mounted on the frame;

a roller body rotatably mounted on the frame and driven by the motor and having an outer profiled surface for substantially matching the contoured surface on the substrate;

a central hub portion on the roller body defining a longitudinal central axis about which the roller body will rotate;

a first section of the roller body extending radially outwardly of the central axis at a first distance;

at least one second section of the roller body extending radially outwardly on the roller body at greater distance than the first distance and joined to the first section to create said outer profiled surface on the roller body;

an abrasive surface on the outer profiled surface of the roller for abrading the contoured surface on the substrate;

the roller body having an outer layer of soft, deformable material that is deformable from its relaxed shape when the profiled roller's abrasive layer is pushed against substrate contoured surface to deflect and to form a flat extending linearly in the direction of substrate travel relative to roller body, the roller body also deflecting laterally to wrap or fill about the substrate contoured surface.

13. An apparatus in accordance with claim 12 wherein the abrasive surface comprises abrasive particles embedded into the roller body.

14. A method of abrading a contoured surface on a substrate, comprising the steps of:

providing a profiled, abrading surface on a roller body having an outer layer of soft, compressible material;

forcing the profiled, abrading surface on the roller with enough force to make a flat surface in the soft, outer layer of the roller body in the direction of linear travel of the substrate relative to roller body;

expanding the profiled surface laterally relative to the contoured substrate surface while abrading;

traveling the substrate relative to the roller body in a linear travel direction; and rotating the roller body and abrading the contoured surface of the substrate while the soft roller body is flattened in the linear direction and expanded in the lateral direction.

15. A method in accordance with claim 14 wherein the substrate includes a convex rounded surfaces, and includes this step of:

wrapping the abrading surface laterally about a substantial lateral area of the convex area while the substrate is traveling linearly relative to the rotating roller body.

16. A method in accordance with claim 14 wherein the substrate includes a concave surface in a groove including the step of:

wrapping the abrading surface laterally within the groove about a substantial lateral area of the groove while the substrate is traveling linearly relative to the rotating roller body.

17. A method in accordance with claim 14 including the step of abrading adjacent areas of the substrate with different hardness from the roller body.

18. A method in accordance with claim 14 including the steps of:

separating different sections of the roller body from each other; and deflecting the adjacent, separated sections about different substrate contours.

* * * * *